US005797283A

United States Patent [19]

Kaczmarczyk

[11] Patent Number: 5,797,283

[45] Date of Patent: Aug. 25, 1998

[54] CROCHET KNITTED DECORATIVE RIBBON WITH SEVERABLE SECTIONS FORMING DECORATIVE CURLS

[75] Inventor: Christina T. Kaczmarczyk, Williamstown, Mass.

[73] Assignee: Novtex Corp., North Adams, Mass.

[21] Appl. No.: 855,994

[22] Filed: May 14, 1997

[51] Int. Cl.[6] ..... D04B 23/08; D04B 23/10

[52] U.S. Cl. ..... 66/193

[58] Field of Search ..... 66/193, 192

[56] References Cited

U.S. PATENT DOCUMENTS

| | | | |
|---|---|---|---|
| 1,139,343 | 5/1915 | Clewley | 66/193 |
| 3,999,407 | 12/1976 | Odham | 66/193 |
| 4,074,543 | 2/1978 | Schmidt | 66/193 |
| 5,074,129 | 12/1991 | Matthew . | |
| 5,265,445 | 11/1993 | Shytles et al. | 66/192 |
| 5,472,766 | 12/1995 | Siegel et al. | 66/192 |
| 5,522,241 | 6/1996 | King | 66/193 |

*Primary Examiner*—Andy Falik

*Attorney, Agent, or Firm*—Sughrue, Mion, Zinn, Macpeak & Seas, PLLC

[57] ABSTRACT

A crochet knitted decorative ribbon is formed of longitudinally alternating integral first and second sections. Throughout the length of the ribbon, there exists a plurality of side-by-side, longitudinally extending continuous warp yarns. Further, throughout the ribbon, a continuous weft yarn interconnects adjacent warps at connecting points defined by chain stitches at alternating intervals. The first sections constitute flat solid pattern sections, with the weft yarns extending sinusoidally across the full width of the ribbon and longitudinally over the full length of the section. In each second section, continuous weft yarn portions interconnect only given sets of at least one warp yarn at connecting points defined by chain stitches at alternating intervals, leaving free longitudinal spaces between respective adjacent strands. Preferably at least two warp yarns of a strand have shrink-back properties which are sufficiently different from each other, so that upon transverse severance of the strands, the severed ends of the strands curl up to produce a pleasant, aesthetic curled fringe along at least one transverse edge of a first section of the ribbon.

9 Claims, 3 Drawing Sheets

CROCHET KNITTED DECORATIVE RIBBON WITH SEVERABLE SECTIONS FORMING DECORATIVE CURLS

BACKGROUND OF THE INVENTION

1. Field of the Invention

This invention relates to machine manufactured crochet knitted fabrics, and more particularly to a crochet knitted decorative ribbon formed of longitudinally alternating first and second sections, the first sections being flat solid pattern sections, where all the warps are joined across the width of the fabric by weft yarns, and the second sections are sections formed of separate strands of fabric, with the weft of the fabric traversing selectively one, two or more warp yarns only, leaving lateral spaces between the separated strands, with the adjacent warps of each strand having distinctly different shrink-back properties with the same tension or the same shrink-back properties but different tension.

2. Description of the Prior Art

Machine manufactured crochet knitted fabrics may be produced in a broad range of widths from as little as ⅛ inch or less, depending on the closeness of the needle spacing the crochet knitting machine, to as much as 60 inches or more, depending on the total width of the needle bed. Such textiles are fabricated particularly as narrow fabrics, useful for the production of decorative trimmings and ribbons. Applicant's corporate assignee commonly owns this application and U.S. Pat. No. 5,074,129 issued Dec. 24, 1991 to John B. Matthew and entitled "FORMABLE FABRIC". The invention of the '129 patent is directed to a crochet knitted fabric which has the property of retaining its shape when stretched in the weft direction and is comprised of soft permanently formable metallic wires inserted into the warps formed of chain stitches which engage soft permanently formable wires, with the weft yarns interconnecting adjacent warps at connecting points defined by chain stitches at all alternating intervals. The '129 a patent is exemplary of the formation of narrow fabrics such as ribbons with transversely extending weft yarns interconnecting continuous longitudinally extending warps, which is the basic manner of crochet knitting fabrics having usefulness and forming a different knit fabric with distinctly different characteristics and properties from that of the '129 patent.

It is therefore an object of this invention to provide a fabric, preferably a decorative ribbon or trimming, which includes at least one flat solid pattern section integrally joined to a further section formed of strands of fabric across the full width of the ribbon which are formed by having the weft of the fabric traverse at least one warp only and leaving lateral spaces between the joined strands over the full length of the further section. Those warps of a given strand are comprised of one, two or more warp yarns having distinctly different shrink-back properties but subject to the same tension, with the second section being immediately joined to a further first section, and the first and second sections alternating. As such, when the second section has its strands severed adjacent to an end of a first section, or otherwise the strands shrink-back and curl, giving a highly pleasing effect to the free ends of strands of the now severed second section. Such trimmings or ribbons are useful in wrapping gift packages and the like. Alternatively, the warps may have the same shrink-back property but set at different tensions.

SUMMARY OF THE INVENTION

This invention therefore relates to a crochet knitted decorative ribbon of a given width and length comprising longitudinally alternating first and second sections. Each first section is a flat solid pattern section comprised of a plurality of continuous longitudinally extending warp yarns, with chain stitches thereof engaging weft yarns across the width of the fabric. Each of the second sections may comprise adjacent ones of the continuous longitudinally extending weft yarns forming sets with the weft yarns of second sections traversing one, two or more warps only, leaving free lateral spaces between the sets defining multi-warp yarn strands. The longitudinal warps throughout the fabric during braiding are alternating formed of yarns which may have different shrink-back properties with the yarns at the same tension or the same property but set at different tensions, such that when the laterally separate strands within the second sections are severed transversely across the complete ribbon, the free ends of the strands curl due to the different shrinkage of the warp yarns, thereby providing a highly pleasing aesthetic effect to the decorative ribbon at one or both ends of a first ribbon section.

DESCRIPTION OF THE PREFERRED EMBODIMENT

Figure 1:
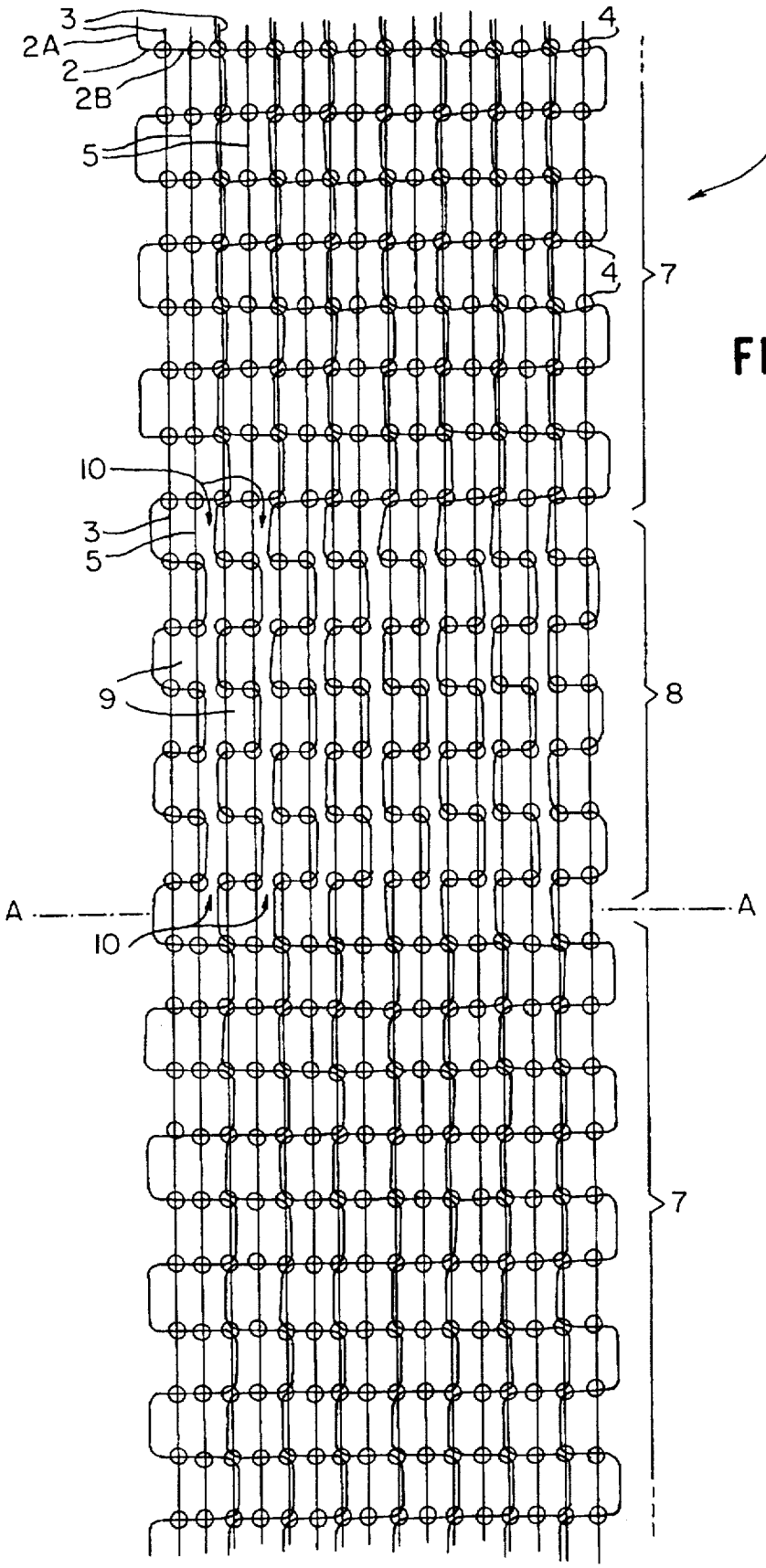
FIG. 1 is a diagrammatic plan view of a crochet knitted fabric with alternating first and second sections, the first being a flat solid pattern with all warps joined across the width of the fabric, and the second section being individual separate longitudinal strands of fabric with the weft of the fabric traversing two or more-selected adjacent warp yarns only, leaving spaces between the longitudinally extending strands.

Referring to FIG. 1, a crochet knitted decorative ribbon indicated generally at 1 is manufactured of alternating first flat solid pattern sections 7 integrally joined by second alternating sections 8.

The first sections 7 are flat solid pattern sections where all of the warp yarns 3, 5 are joined across the lateral width of the ribbon or fabric 1. In the illustrated embodiment, weft yarns 2 traverse at least three warp yarns as at 3, 5 and join with other portions of the fabric 1 of three adjacent warps. In contrast, the second sections 8 are characterized by the weft yarns 2 which traverse only two adjacent warp yarns 3, 5 in section 8 forming a set and which weft yarns work back and forth over the length of given separate strands 9 which are separated from each other by open spaces 10. The weft yarns 2 in perform this function by alternately forming longitudinal portions 2A integral with and extending transversely as at 2B, at right angles to the longitudinal extent of the fabric or ribbon content. The warp yarns throughout the fabric 1 alternate yarns having a low shrink-back property when severed with yarns having a greater shrink-back property when severed. The warp yarns may be under the same tension during knitting. The difference in shrink-back is significant between warp yarns 3, 5 in the illustrated embodiment.

In the manufacture of the relatively narrow ribbon 1, the separated strands 9 remain in place, being spaced from adjacent strands to either side by the formed spaces 10. Upon transverse severance of the strands of section 8 of ribbon 1 at the intersection of a trailing edge or a leading edge of that section with a leading or trailing edge, respectively, of the next succeeding first section 7, or inbetween the leading and trailing edges, the free ends of strands 9 shrink back unevenly so that the strands 9 naturally curl to provide a very pleasing aesthetic look to the ribbon 1 in deep contrast between the flat solid pattern section 7 and integral laterally spaced strands 9 of sections 8. Such ribbon can be employed, as for instance in doll making, by using the strand curls as artificial hair for the doll and attaching a flat solid pattern section 7 to the head of the doll with the curls flowing downwardly thereof.

Figure 2:
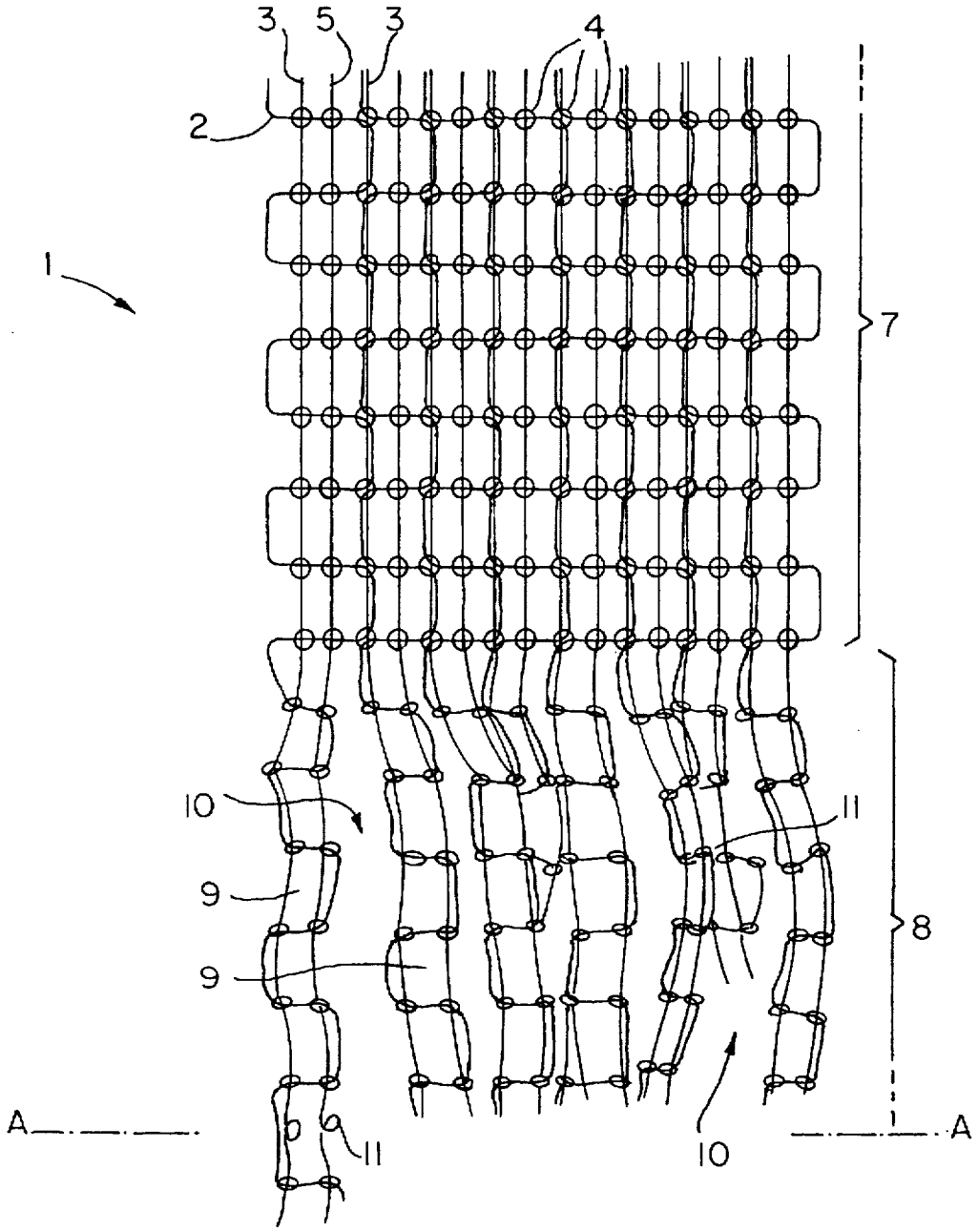
FIG. 2 is a plan view of a given length of severed ribbon of FIG. 1 by severing the ribbon 1 of FIG. 1 about a transverse severance line A—A, joining one ribbon section to a second succeeding ribbon section.

As may be apparent, the length of the pattern and strand sections can be varied for decorative uses, and the lengths of the various sections 7, 8 do not effect the reaction of the warp yarns in shrinking back when severed from their captured positions between the flat solid pattern sections making up the ribbon 1. The imbalance in the way the materials making up the adjacent warps or warp yarns 3, 5 in the crochet stitches 4 causes the two-warp strands 9 to curl and corkscrew when severed is illustrated in FIG. 2.

As may be appreciated in the manner of U.S. Pat. No. 5,074,129, the specific pattern of weft yarns is controlled by pattern bars of the crochet knitting machine (not shown).

The invention is not limited to the specific embodiment as illustrated and described above. In the illustrated embodiment, the warp yarns 3 of a given shrink-back property may be polypropylene or polyester yarn, while alternating warp yarns 5 with a distinctly different shrink-back property may be of monofilament or lycra in a given form of the invention. In turn, the weft yarns or threads 2 may be of polyester, polypropylene, metallic film, acrylic, rayon, cotton or paper. Further, the length of the solid pattern section and the lengths and widths of the individual strands 9 of strand sections can be varied as desired. In the stranded section 8, the weft yarns 2 travel over two warps 3, 5 leaving spaces 10 between the strands 9. To enhance shrink-back of a given warp yarn, such as that at 3, relative to a warp yarn 5 having less shrink-back property or characteristic, the yarn 3 may be an elasticized yarn. Further, the shrink-back property or characteristic of a given warp yarn can be varied by varying the tension on a given warp yarn during knitting relative to an adjacent warp yarn of a given strand. Moreover, the tension effect in the warp yarns of the individual strands may be varied by exposing the given strands to further processing to remove preset tension effects. The tension itself on the respective warp yarns may be set so as to modify the tendency of the individual warp yarns 3, 5 to shrink by stretching the yarn to a greater extent prior to severance of the strands within a section or sections 8 or at the junction of strands 9 with a solid section 7. Cutting may be had of the ribbon 1 adjacent the edge interface between sections 7, 8 at the ends of the spaces 10, or transversely at some position inbetween the opposite ends of the spaces 10. The warp yarns may be of contrasting color or of the same color as desired. Further, the warp yarns may have a reflective surface, or may be relatively dull.

Figure 3:
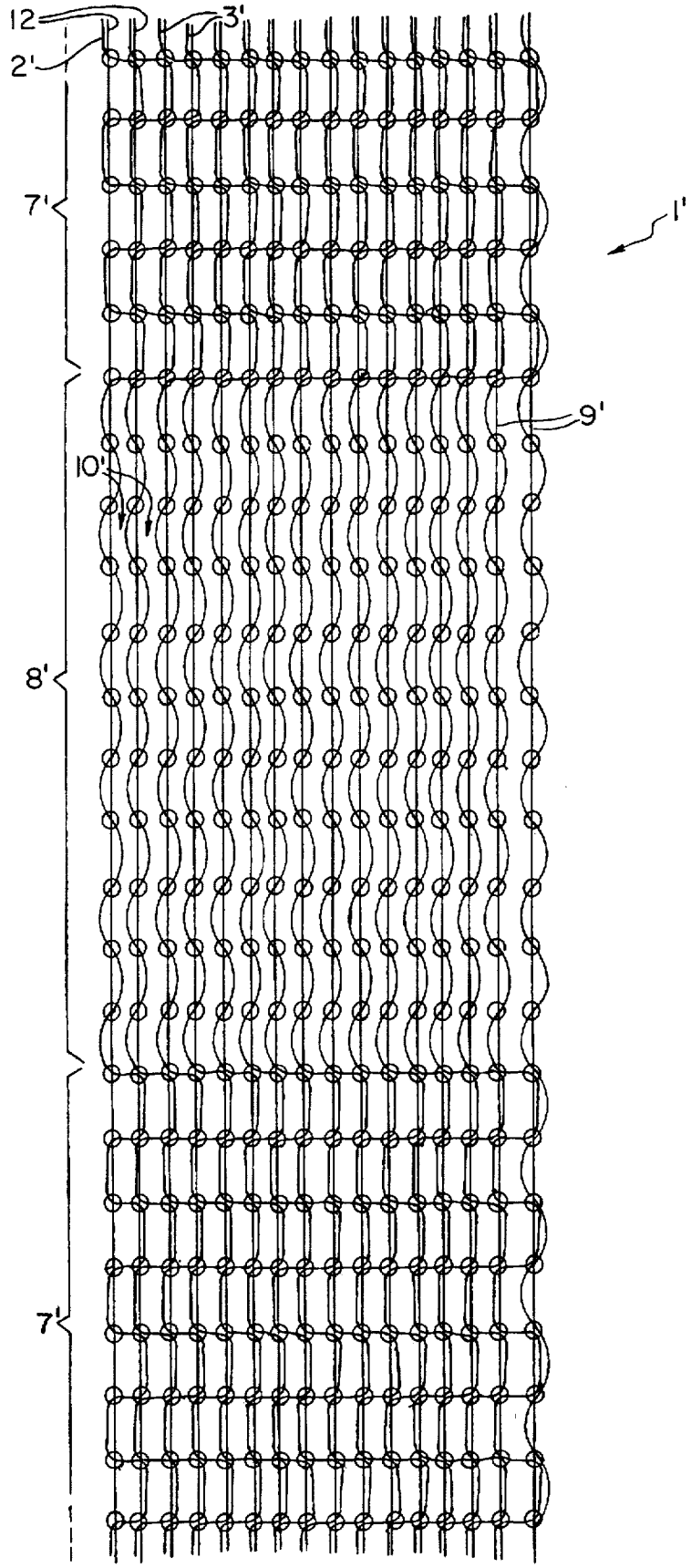
FIG. 3 is a plan view of a ribbon forming a second embodiment of the invention with alternating first and second sections with warp yarns carrying warp in inserts of different shrink-back property from the warp yarns and with each warp yarn and warp in insert defining separate strands in the second section of the ribbon.

The weft threads or yarns in travelling over the sinuous path during knitting may travel across three or more adjacent warp yarns or may be limited to travelling transversely only over one warp yarn as in the illustrated embodiment of FIG. 3.

A second embodiment of the invention is shown in FIG. 3 by alternating second sections 7' and 8'. Like the first embodiment, the warp yarns 2' are joined across the lateral width of the ribbon or fabric 1'. However, the weft yarns 2' traverse only two warp yarns 3' in solid pattern section 7', but in doing so join other portions of the fabric 1' of two adjacent warps. Further, in this embodiment, the ribbon is different since each of the warp yarns 3' carry warp in inserts 12 which preferably have distinctly different shrink-back properties from the warp yarns which carry the same. As may be appreciated, the inserts 12 are similar to the inserts within U.S. Pat. No. 5,074,129 discussed in the description of the prior art within this application. However, in that patent, the inserts are preferably metal wire inserts which are deformable and which may be reformed as needed.

Additionally, in the embodiment of FIG. 3, the longitudinally extending spaces 10' between adjacent warp yarns 3' in the strand curl pattern section 8' form or define strands 9' characterized by a single warp yarn with its parallel and proximately located insert 12. As such, the weft yarns 2' for each strand 9' extend across or contain solely the single warp yarn 3' with its insert 12 for each strand. When the ribbon or fabric 1' is severed somewhere within the strand curl pattern section 8', the strands curl back in the same manner of the embodiment in FIG. 2 to form like curls to those at 11 in that embodiment.

Further, with respect to the embodiment of FIG. 3, it is not necessary that the warp inserts 12 accompany the warp yarns 3. The warp yarns 3 may be formed solely of elasticized material in which the manufacture of the elasticized yarn provides the stretchability and shrinkability characteristics of elasticized yarn material such that when the fabric or ribbon 1' is knitted into joined sections 7', 8' upon transverse or lateral severance of the strands 9' within section 8', the free ends of the strands curl back due to the release of tension which is necessary in effecting the knitting operation of the ribbon 1'. Thus, from the embodiments described in detail, it is apparent that various changes may be made without departing from the invention. The warp yarns may be of the same material, but of alternating different tensions, different materials with different shrink-back properties, but knitted with the same tension on all warp yarns, or the warps may have warp in inserts of different shrink-back properties from the warp yarn materials, but subject to the same tension, or the same shrink-back properties, but the insert subject to ha different tension from that of the warp yarn proximate thereto. Additionally, as discussed in a modification of the embodiment of FIG. 3 in which the warp yarns are formed of an elastic (inherently stretchable) yarn which is subject to significant tension during ribbon manufacture permitting significant axial shrinkage or relaxation after severance of the strands within the strand curl pattern section 8'. The description with respect to the second embodiment is in itself a modification of the first embodiment of FIGS. 1 and 2 and reference may be had thereto for common manufacturing and structural content.

The invention is thus applicable to the manufacture of decorative ribbons or tapes, the free ends of which having built-in curls subject only to transverse severance of the tape or ribbon adjacent section lines or within the stranded sections 8. Upon severance of strands 9, the unequal retraction or shrinkage of the warp yarn content within those sections 8 cause the inherent curling of the free ends of the strands. Both the warp and the weft material may be variously colored, and the ribbon may have a rainbow effect depending upon the number of different colored weft and warp yarns employed in the manufacture of the crochet knitted fabric. The illustrated embodiments are exemplary only of several forms, which the invention may take, and the invention is broadly directed to the following claims.

It is important to note that in the ribbon first flat, solid pattern sections 7 all of the warp yarns are joined across the width of the fabric, with the weft yarns traversing three adjacent warp yarns in the illustrated embodiment first sections 7, FIG. 1. The next weft yarn in turn traverses transversely three warps with other three adjacent warp groups being similarly joined over the full width of the fabric.

In contrast, in the first illustrated embodiment, each second section 8 is formed completely of laterally spaced, longitudinally extending strands of at least two adjacent warps or warp yarns which are bound together by weft yarn portions interconnecting only two adjacent warps at connecting points defined by chain stitches at alternating intervals. The result is to create free longitudinal spaces 10 over the length of each section 8 between integral sections 7 above and below the same, allowing a section 8 to be severed throughout the width of the ribbon at any location intermediate of the flat solid pattern sections 7.

As may be appreciated, with the adjacent warp yarns 3, 5 throughout the ribbon 1 being formed of materials having significantly different shrink-back properties, the invention is not limited to having strands 9 formed only of two or more adjacent warp yarns, the strands may be formed of one, three or more adjacent warp yarns with at least two warp yarns of a given strand having different shrink-back properties but set at the same tension, in which case the strands when severed will shrink back unevenly, causing the strands to curl up as illustrated in FIG. 2. Where the strands are formed of three, four or more adjacent warp yarns, the weft yarns, which extend across the width of the strands connect with the weft yarns at connecting points defined by warp yarn chain stitches at alternating intervals and interconnect only the multiple warp yarns for each given strand in question and never extend across the spaces 10 between adjacent strands 9. As such, when the strands within a second section 8 are severed, the severed strand ends are free and the strands are connected only to a first section 7 from which the strands 9 emanate, and when the severed strands are released, the severed ends curl up in the manner illustrated in FIG. 2.

What is claimed is:

1. A crochet knitted decorating ribbon of a given width and length comprising:

longitudinally extending, integral, alternating first and second ribbon sections, each said first section being a flat solid pattern section comprising a plurality of side-by-side longitudinally extending continuous warp yarns, continuous weft yarns extending over the length of said ribbon and having transverse portions extending laterally across the ribbon, and said weft yarn portions in said first section interconnecting adjacent warp yarns at connecting points defined by warp yarn chain stitches at alternating intervals;

and wherein each said second section comprises a plurality of equal width, laterally separated strands across the full width of said ribbon defined by at least one warp yarn, with said continuous weft yarn portions extending across said at least one warp yarn interconnecting only said at least one warp yarn for each strand at connecting points defined by chain stitches at alternating intervals within said second section, thereby defining longitudinally extending free spaces separating respective adjacent strands within said second section and extending the full length of each said second section, and wherein said at least one warp yarn of said ribbon strands within each second section have a distinct shrink-back property under tension such that by severing said ribbon transversely through the strands of said second section, the severed ends of said strands automatically curl up on themselves, thereby producing a highly pleasing, aesthetic curled fringe along at least one transverse edge of each first section of said ribbon.

2. A crochet knitted decorating ribbon as claimed in claim 1, wherein each of said strands in said second section comprises at least two adjacent warp yarns of different shrink-back properties under the same tension, and said weft yarn portions interconnect only said at least two adjacent warp yarns of each strand, over the full length of the strands within each second section of said ribbon.

3. A crochet knitted decorating ribbon as claimed in claim 1, wherein one of adjacent warp yarns is of a material selected from the group consisting of polypropylene and polyester; and said other of said adjacent warp yarns is of a material selected from the group consisting of monofilament and lycra.

4. A crochet knitted decorating ribbon as claimed in claim 2, wherein one of said adjacent warp yarns is of a material selected from the group consisting of polypropylene and polyester; and said other of said adjacent warp yarns is of a material selected from the group consisting of monofilament and lycra.

5. A crochet knitted decorating ribbon as claimed in claim 3, wherein said weft thread is formed of a material selected from the group consisting of polyester, polypropylene, metallic film, acrylic, rayon, cotton and paper.

6. A crochet knitted decorating ribbon as claimed in claim 4, wherein said weft thread is formed of a material selected from the group consisting of polyester, polypropylene, metallic film, acrylic, rayon, cotton and paper.

7. A crochet knitted decorating ribbon as claimed in claim 1, wherein said warp yarns are of an elasticized material prestretched over said first and second sections.

8. A crochet knitted decorating ribbon as claimed in claim 1, wherein each of said strands in said second section comprises at least two adjacent warp yarns of the same shrink-back property under different tension, and said weft yarn portions interconnect only said at least two adjacent warp yarns of each strand over the full length of the strands within each second section of said ribbon.

9. A crochet knitted decorating ribbon as claimed in claim 1, wherein each warp yarn includes an insert of a distinctly different shrink-back property from that of said warp yarn, and said warp yarn and said insert are under the same tension.

* * * * *